US006715737B2

(12) United States Patent
Galka et al.

(10) Patent No.: US 6,715,737 B2
(45) Date of Patent: Apr. 6, 2004

(54) FUEL METERING SYSTEM FOR A CARBURETOR

(75) Inventors: William E. Galka, Caro, MI (US); Bradley D. Hilbig, Rio Rico, AZ (US); Ronald H. Roche, Cass City, MI (US); James E. Van Allen, Clifford, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 10/226,551

(22) Filed: Aug. 23, 2002

(65) Prior Publication Data

US 2002/0195726 A1 Dec. 26, 2002

Related U.S. Application Data

(63) Continuation-in-part of application No. 09/650,166, filed on Aug. 29, 2000, now Pat. No. 6,446,939.

(51) Int. Cl.[7] ..... F02M 17/04
(52) U.S. Cl. ..... 261/35; 261/69.1; 261/DIG. 68
(58) Field of Search ..... 261/69.1, 69.2, 261/35, DIG. 68

(56) References Cited

U.S. PATENT DOCUMENTS

| | | | | | |
|---|---|---|---|---|---|
| 2,713,854 | A | * | 7/1955 | Conover | 123/73 A |
| 2,796,838 | A | * | 6/1957 | Phillips | 417/395 |
| 3,065,957 | A | * | 11/1962 | Phillips | 261/35 |
| 3,104,617 | A | * | 9/1963 | Barr | 417/479 |
| 3,141,048 | A | | 7/1964 | Schneider | 261/41.1 |

(List continued on next page.)

FOREIGN PATENT DOCUMENTS

| | | |
|---|---|---|
| DE | 1188366 | 3/1965 |
| DE | 1254404 | 11/1967 |
| FR | 1462245 A | 12/1966 |
| JP | 09189265 | 7/1997 |

OTHER PUBLICATIONS

References X'd were cited in parent case SN 09/650,166.*

*Primary Examiner*—Richard L. Chiesa
(74) *Attorney, Agent, or Firm*—Reising, Ethington, Barnes, Kisselle, P.C.

(57) ABSTRACT

A fuel metering system for a combustion engine carburetor utilizes a non-convoluted, planar, flexible diaphragm which does not require a molding process to form a traditional convolution. The diaphragm defines in part a pressure controlled fuel metering chamber on one side and a reference chamber at atmospheric pressure on the other side. During operation of the engine, sub-atmospheric pressure within a fuel and air mixing passage draws fuel from the metering chamber to mix with air for combustion within the engine. As pressure within the metering chamber thus decreases, the diaphragm flexes into metering chamber. The displacement of the diaphragm actuates a flow control valve of the metering system which flows pressurized make-up fuel into the metering chamber until the diaphragm returns to its datum position. Preferably, hardware of the flow control valve which is in direct contact with a surface of the diaphragm exposed to the metering chamber does not penetrate the diaphragm as the traditional rivet and washer assembly would. Therefore, manufacturing costs are reduced and any opportunity of leakage between the fuel metering chamber and reference chamber is eliminated. Preferably, the carburetor is of a manual external purge type in order to exert sufficient vacuum within the metering chamber to displace the metering diaphragm thus opening the flow control valve to purge the carburetor of unwanted fuel vapor and air prior to starting the engine. The novel planar diaphragm thereby resolves problems associated with traditional metering diaphragms such as variation in convolution datum height affecting flow control valve lever/diaphragm clearances, non-symmetric convolution axis or distorted convolution affecting diaphragm pressure response and recovery.

13 Claims, 4 Drawing Sheets

U.S. PATENT DOCUMENTS 3,160,683 A * 12/1964 Johnson ..... 261/69.2
3,201,096 A * 8/1965 Barr ..... 261/41.5
3,235,236 A * 2/1966 Kalert, Jr. ..... 261/41.5
3,272,485 A * 9/1966 Newman ..... 261/35
3,367,637 A 2/1968 Hazzard ..... 261/37
3,441,010 A * 4/1969 Barr et al. ..... 123/445
3,738,623 A * 6/1973 Tuckey ..... 261/35
3,746,320 A * 7/1973 Van Camp et al. ..... 261/35
3,825,237 A * 7/1974 Aoyama et al. ..... 261/35
4,003,968 A * 1/1977 Rickert ..... 261/35
4,159,012 A 6/1979 Pizzuto et al. ..... 261/3.5 X
4,563,311 A * 1/1986 Agnew ..... 261/35
4,824,613 A * 4/1989 Scott et al. ..... 261/35
4,978,478 A * 12/1990 Vonderau et al. ..... 261/35
5,093,067 A 3/1992 Gibson ..... 425/543 X
5,250,233 A * 10/1993 Swanson ..... 261/34.2
5,262,092 A 11/1993 Reeder et al. ..... 261/35
5,283,013 A * 2/1994 Gerhardy ..... 261/35
5,487,861 A 1/1996 Reeder et al. ..... 264/257
5,599,484 A 2/1997 Tobinai ..... 261/44.2
5,681,508 A * 10/1997 Gerhardy ..... 261/35
5,709,822 A 1/1998 Togashi ..... 261/44.2
5,891,369 A * 4/1999 Tuggle et al. ..... 261/35
6,267,102 B1 7/2001 Parrullo et al. ..... 123/437
6,293,524 B1 9/2001 Endo et al. ..... 261/34.2
6,382,598 B1 5/2002 Terakado ..... 261/351
6,382,599 B1 5/2002 Aihara et al. ..... 261/37
6,446,939 B1 * 9/2002 Hoppe et al. ..... 261/35

* cited by examiner

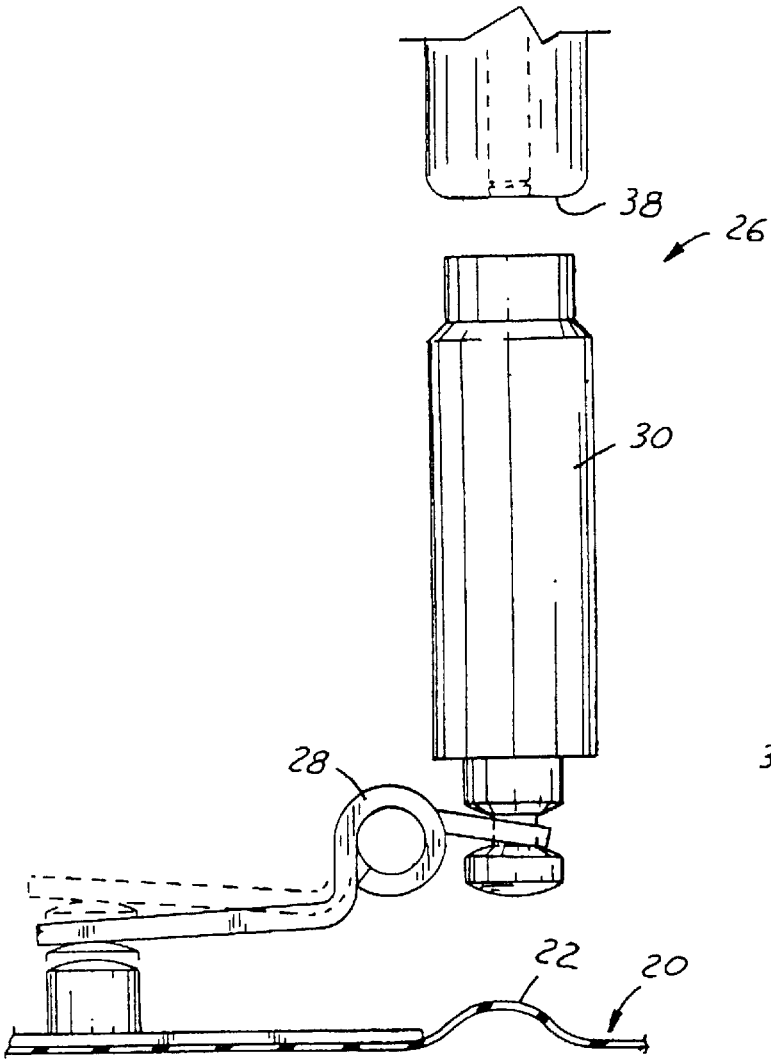
(PRIOR ART) FIG. 8
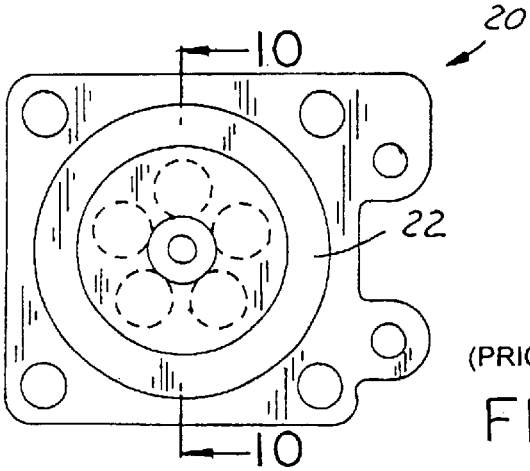
(PRIOR ART) FIG. 9
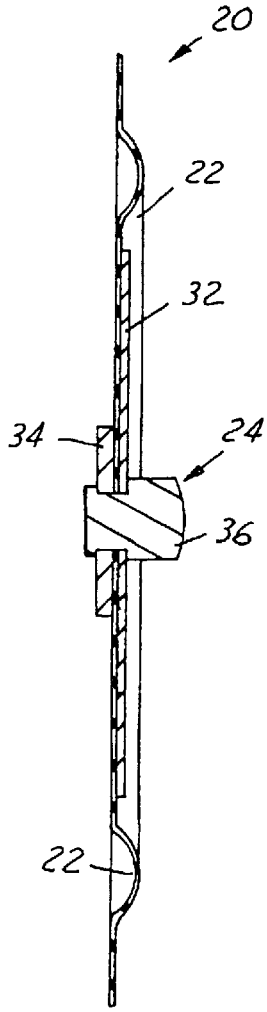
(PRIOR ART) FIG. 10

FUEL METERING SYSTEM FOR A CARBURETOR

REFERENCE TO RELATED APPLICATION

This application is a continuation-in-part of Ser. No. 09/650,166, filed Aug. 29, 2000 now U.S. Pat. No. 6,446,939.

FIELD OF THE INVENTION

The present invention relates to a fuel metering system, and more particularly to a fuel metering system having a planar diaphragm for an externally-purged-type carburetor.

BACKGROUND OF THE INVENTION

Typically, carburetors have been used to supply a fuel-and-air mixture via an intake passage to both four stroke and two-stroke internal combustion engines. For many applications where small two-stroke engines are utilized, such as hand held power chain saws, weed trimmers, leaf blowers, garden equipment and the like, carburetors with both a diaphragm fuel delivery pump and diaphragm fuel metering system have been utilized. When the engine is operating, the diaphragm fuel delivery pump supplies fuel under pressure to the diaphragm fuel metering system through an inlet or flow control valve of the fuel metering system, which in-turn supplies fuel to a fuel-and-air mixing passage of the carburetor for mixing with air prior to flowing into a combustion cylinder of the engine.

A convoluted flexible diaphragm or membrane of the fuel metering system typically has a peripheral edge sealed to the carburetor body. A metering chamber and an air chamber is thus partitively disposed over and under the diaphragm, respectively. During operation, when the amount of fuel in the chamber decreases and the convoluted diaphragm is moved due to a negative pressure in the fuel-and-air mixing passage, the flow control valve is opened against the force of a spring by a pivoting lever that operates together with the diaphragm and is fixed to a wall of the carburetor body by a support shaft. In this way, the fuel is supplied from the fuel delivery pump to the metering chamber. As a result, the amount of fuel in the metering chamber is kept at about a constant level or volume.

Commonly, the carburetor has an external purge or manually actuated primer or suction pump having a flexible bulb attached to the bottom side of the carburetor body. The bulb internally defines a pump chamber in which a composite valve functions to admit fuel to the pump chamber and deliver fuel to the metering chamber of the fuel metering system. Moreover, before the engine starts for operation, the bulb is repetitively manually pressed and released to suck unwanted fuel vapor and air from the fuel pump and fuel metering system into the pump chamber of the external purge via the composite valve. The fuel vapor and air are transferred back to the fuel tank via the composite valve. At this time, since the metering chamber is under a negative pressure, the fuel in the fuel tank is supplied to the metering chamber through a fuel chamber of the fuel delivery pump and the flow control valve.

The diaphragm of the fuel metering system typically has five basic functions: (1) maintain a seal between the air and the metering chambers, (2) respond instantly to differential pressure (engine manifold pressure referenced to atmospheric), (3) open the flow control valve when the engine needs fuel, (4) close the flow control valve when the engine has enough fuel, and (5) perform consistently over the life of the engine (i.e., no loss of elastomeric flexibility of the convoluted diaphragm from age or fuel exposure).

The convoluted metering diaphragm is typically made of an elastomeric membrane and molded to form convolutions to achieve flexibility and a pre-established total travel distance necessary to open and close the flow control valve. This total travel distance commonly ranges from about 0.020 to 0.065 of an inch, and includes a degree of free-play before a head of the flow control valve actually moves to open and close the valve. During engine operation, from idle to wide open throttle conditions, the convoluted diaphragm typically moves approximately within a range of 0.001 to 0.015 of an inch and thus the head proportionately moves accordingly. This range depends upon the carburetor and its application. FIGS. 8–10, illustrated as prior art, show such a metering diaphragm 20 having a molded convolution 22. Under normal engine/carburetor operating conditions, a center or circular section 24 of the diaphragm, circumscribed by the convolution 22, provides the primary movement for operation of the flow control valve 26. The convolution itself has little contribution to achieving the required fuel delivery pressure balance in the metering chamber (not shown). The metering diaphragm 20 transmits a relative movement to a pivoting lever 28 which transmits opposite movement to a head 30 of the flow control valve 26 based on a pressure differential formed across the diaphragm. The differential is initiated from the sub-atmospheric pressure exposed to the metering chamber by the fuel-and-air mixing passage of the carburetor and the reference atmospheric pressure of the air chamber of the metering system.

FIGS. 8 and 9 illustrate the common convoluted metering diaphragm 20 having a central rigid plate 32, a washer 34 and a rivet button 36 for transmitting this force to the pivoting and spring biased lever 28 of the flow control valve 26, which in turn moves the valve head 30 away from a valve seat 38 carried by the carburetor body to open, and against the valve seat 38 via the resilience of the spring (not shown) to close the valve. The diaphragm must have sufficient resilience for transmitting displacement in proportion to the pressure differential, yet remain flexible enough to respond to sudden changes in pressure such as for engine acceleration and engine starting. Unfortunately, the cost of manufacturing a flexible diaphragm having rigid hardware which is engaged sealably to the diaphragm is expensive, and the diaphragm penetration required to secure the hardware creates a source of potential leakage between the metering chamber and the reference chamber.

Aside from the rigid hardware, there are several reasons for the additional diaphragm travel afforded by the convolution in a standard diaphragm carburetor design. The convolution provides extra material for maintaining diaphragm flexibility should the fabric or elastomer coating shrink (typically made of woven silk and nitrile material) upon exposure to hydrocarbon fuels or aging effect. This extra material measured or extending perpendicular to the general plan of the diaphragm itself also maintains necessary operating clearances or free-play travel distance between the pivoting lever and diaphragm if this shrinkage occurs. The extra convolution material also allows more diaphragm travel (increased metering fork leverage) to "uncork" a stuck head of the flow control valve, particularly for carburetors which do not have a manual external purge or bulb device to create a strong vacuum. In-other-words, the convolution assists to release stuck heads for those carburetors which utilize the weaker engine manifold vacuum in combination with a choke valve to generate the metering chamber vacuum for opening the flow control valve for purging the carburetor of air or vapor to better start the engine.

However, there are also inherent problems associated with the metering diaphragm convolution which have adverse impact on carburetor performance. Such problems include the inadvertent changes in baseline carburetor fuel flow settings, inconsistent fuel delivery and exhaust emission variation, poor acceleration response, and the potential for leaking/dripping from the carburetor main nozzle. For instance, a distorted convoluted diaphragm can change the original or installed operating clearance between the rivet button and the lever so that an adverse shift in idle performance due to vibration or orientation of the engine can cause fuel leakage leading to a rich idling engine. At wide open throttle conditions, such fuel leakage can result in engine stall during deceleration from wide open throttle to idle. For non-running engines, a distorted convolution which eliminates clearance can depress the lever to allow fuel leakage out of the carburetor causing fuel tank drainage.

The process of convolution molding is known to contribute to variations in diaphragm flexibility based on molding temperatures and pressures, and aging which is also influenced by the composition of the elastomeric material and substrate fibers. Natural cotton or silk substrates have been used historically for flexibility and elastomeric bonding, but these natural fibers in combination with a molded convolution are susceptible to hygroscopic absorption leading to uncontrolled changes in convolution height influenced by ambient humidity which directly adversely impacts the operating clearance. Use of nylon or other synthetic polymers in lieu of natural fibers as the substrate material for the molding process to create the convolution may contribute to additional molding stress and memory set of the convolution resulting in diaphragm rigidity and inconsistent response to small differential pressures. Thickness variation of the elastomeric coating and its cured state also contribute to poor diaphragm response and flexibility changes through molding the metering diaphragm convolution. Pin holes or elastomer tears can occur at the base of the convolution during the molding process where the base material is squeezed and stretched under heat and pressure, leading to potential fuel and/or air leaks across the metering diaphragm.

In addition, residual stresses from both the molding process and fabrication of the diaphragm material can be accentuated upon exposure to hydrocarbon and aromatic compounds in the fuel causing diaphragm convolution distortion or changes in material property. For example, conventional Nitrile rubber compounds can lose plasticicizers blended in the rubber from fuel leachment breaking the elastomeric chemical bonds resulting in adverse stiffness affecting flexibility characteristics of the convoluted metering diaphragm. Other types of elastomeric and substrate materials may also exhibit various degrees of swell, shrinkage, and flexibility characteristics exacerbated by the convolution which alter the ability of the diaphragm to respond consistently and repeatably to small pressure differentials.

Specific convolution anomalies involving convoluted metering diaphragms include variation in convolution datum height affecting lever/diaphragm clearances, non-symmetric convolution axis or distorted convolution affecting diaphragm pressure response and recovery, oil canning of the diaphragm during flexure causing erratic diaphragm movement, fuel and air leakage across the diaphragm from holes or tears or poor elastomeric coating processes. These examples contribute inconsistent carburetor fuel flow settings, poor engine acceleration, engine stalls during rollout, hard starting, and fuel leakage/flooding. It becomes more of a prevalent problem on those engine applications with relative weak manifold vacuum, lean carburetor setting for lower exhaust emissions, or large frictional differences in the engine (new versus broke-in engine) which make the carburetor more sensitive to variation in diaphragm flexibility.

SUMMARY OF THE INVENTION

A fuel metering system for a combustion engine carburetor utilizes a non-convoluted, planar, flexible diaphragm which does not require a molding process to form a traditional convolution. The diaphragm defines in part a fuel metering chamber on one side and a reference chamber at near atmospheric pressure on the other side. During operation of the engine, sub-atmospheric pressure within a fuel-and-air mixing passage draws fuel from the metering chamber to mix with air for combustion within the engine. As pressure within the metering chamber thus decreases, the diaphragm flexes into metering chamber. The displacement of the diaphragm actuates a flow control valve of the metering system which flows pressurized make-up fuel into the metering chamber until the diaphragm returns to its datum position. Preferably, hardware of the flow control valve which is in direct contact with a surface of the diaphragm exposed to the metering chamber does not require penetration of the diaphragm, as the traditional rivet and washer assembly does. Therefore, manufacturing costs are reduced and any opportunity of leakage between the fuel metering chamber and reference chamber is eliminated. Preferably, the carburetor is of a manual external purge type in order to exert sufficient vacuum within the metering chamber to displace the planar metering diaphragm thus opening the flow control valve to purge the carburetor of unwanted fuel vapor and air prior to starting the engine. The novel planar diaphragm thereby resolves problems associated with traditional convoluted metering diaphragms such as the variation in convolution datum height affecting flow control valve lever/diaphragm clearances, and non-symmetric convolution axis or distorted convolution affecting diaphragm pressure response and recovery.

Preferably, in order to achieve the flexibility and fuel absorption resistance necessary for the unique operating characteristics of the flat metering diaphragm, the traditional composite material of nitrile and silk fabric is replaced with a a synthetic woven fabric impregnated with a synthetic rubber, such as nylon and nitrile. The nylon fabric has extremely small diameter fiber bundles in the weave providing increased flexibility with favorable recovery characteristics (return to datum position upon removal of differential pressure across the diaphragm). In addition, the elastomeric composition is such that fuel permeability is decreased when compared to that of typical diaphragm materials used in the past. This decrease in fuel permeability is favorable for emission control requirements. Moreover, the synthetic rubber and fabric combination preferably has a surface texture and elastomeric properties conducive to minimal abrasion wear. This is necessary for the preferable novel flow control valve lever of the present invention which must act directly upon the metering diaphragm in both wet and dry environments.

Objects, features and advantages of this invention include a metering diaphragm which is non-convoluted eliminating the convolution height variations created in manufacturing, diaphragm fuel absorption and aging of the traditional diaphragm which adversely affects flow control valve and thus engine operation. Moreover, leakage between the metering and air chamber is eliminated via the novel flow control valve lever of the present invention thereby providing a reliable smooth running engine. Additional advantages are a reduced number of parts, reduced number of manufacturing processes, and a design which is easily incorporated into existing carburetors. This design improves engine performance and is relatively simple and economical to manufacture and assemble, and in service has a significantly increased useful life.

DESCRIPTION OF THE DRAWINGS

These and other objects, features and advantages of this invention will be apparent from the following detailed description, appended claims, and accompanying drawings in which:

FIG. 8 is a partial side view of a prior art fuel metering system;

FIG. 9 is a plan view of a convoluted metering diaphragm of the prior art fuel metering system; and FIG. 10 is a cross-section of the convoluted metering diaphragm taken along line 10—10 of FIG. 9.

DETAILED DESCRIPTION OF THE PREFERRED EMBODIMENTS

Figure 1:
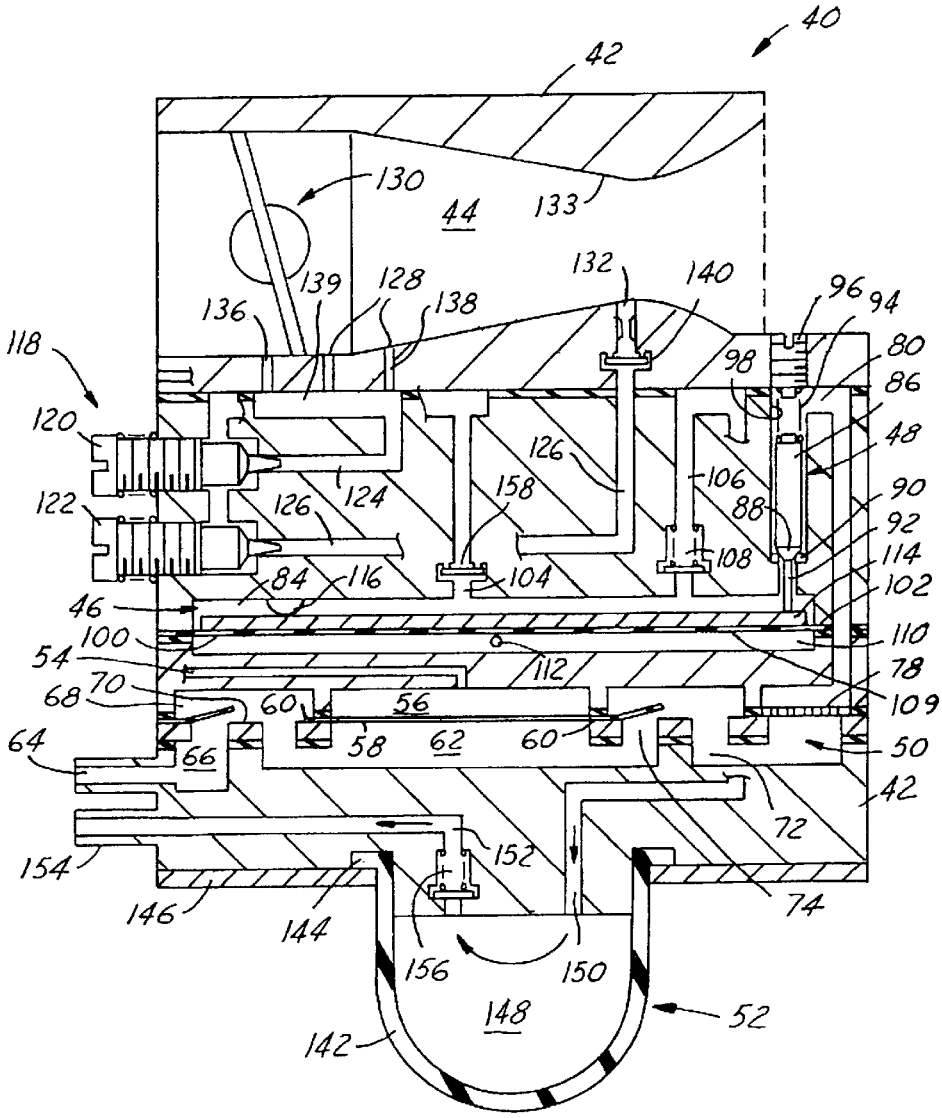
FIG. 1 is a cross-section of an externally purged, butterfly valve type, carburetor having a fuel metering system of the present invention.

Referring in more detail to the drawings, FIG. 1 illustrates a carburetor 40 according to a first embodiment of the present invention which is of a butterfly valve type. Carburetor 40 has a main body 42 through which a fuel and air mixing passage 44 extends. A fuel metering system 46 carried by the body 42 delivers fuel at a controlled pressure to the fuel and air mixing passage 44 and receives fuel through a flow control valve 48 from a fuel pump 50, also carried by the carburetor body. A purge pump assembly 52 is generally mounted externally to the carburetor body for the manual purging of fuel vapor and air from the fuel metering system 46, the fuel pump 50 and associated passages to assist in reliable starting of the engine.

A pressure pulse passage 54 defined by the carburetor body 42 communicates at one end with a crankcase of the engine (not shown) and opens at the other end to a pressure pulse chamber 56 of the fuel pump 50. The fuel pump 50 has a flexible diaphragm 58 engaged sealably to the carburetor body 42 generally along a peripheral edge 60. The fuel pump diaphragm 58 defines in part a fuel pump chamber 62 on one side and the pressure pulse chamber 56 on its other side and is displaceable in response to a difference in pressure between the chambers 56, 62.

When the engine is running, pressure pulses from its crankcase are directed to the pressure pulse chamber 56 via the pressure pulse passage 54. When a negative pressure pulse is transmitted to the pulse chamber 56, the flexible fuel pump diaphragm 58 is moved in a direction increasing the volume of the fuel pump chamber 62 and decreasing the volume of the pressure pulse chamber 56. The increase in the fuel pump chamber volume draws fuel from a fuel pump reservoir or tank (not shown) through an inlet nozzle 64 formed in the carburetor body 42, and through an inlet passage 66 which communicates with the fuel pump chamber 62 and is interposed by an inlet valve 68. The inlet valve 68 controls fluid flow through the inlet passage 66 to the fuel pump chamber 62 and is preferably a flap type valve integral with the diaphragm 60 and adapted to selectively engage a valve seat 70 carried by the body 42 in order to close. The pressure drop caused by the increase in volume of the fuel pump chamber 62 causes the inlet valve 68 to open and to permit fuel to flow from the inlet nozzle 64 to the fuel pump chamber 62.

During the engine cycle, as the pressure in the engine crankcase is increased, a positive pressure pulse will be transmitted through the crankcase pressure pulse passage 54 to the pressure pulse chamber 56 to cause the diaphragm 58 to move in a direction decreasing the volume of the fuel pump chamber 62 and increasing the volume of the pressure pulse chamber 56. The decrease in volume of the fuel pump chamber 62 increases the pressure therein and thereby closes the inlet valve 68 and forces fuel in the fuel pump chamber 62 toward an outlet passage 72 which is interposed by an outlet valve 74. The outlet valve 74 is also preferably a flap type valve integral with the diaphragm 58 and adapted to selectively engage a valve seat 76 to close the outlet passage 72. When a negative pressure condition exists in the fuel pump chamber 62, the outlet valve 74 is closed and a positive pressure in the fuel pump chamber 62 opens the outlet valve 74 to permit the fuel to be subsequently delivered from the fuel pump chamber 62 to the downstream fuel metering system 46. A fuel filter 78 such as a screen or other porous member is preferably disposed across the outlet passage 72 within the body 42.

Fuel which passes through the fuel filter 78 enters a fuel metering inlet passage 80 and is delivered under pressure to the fuel metering system 46 of the carburetor 40. The fuel metering system 46 functions as a pressure regulator receiving pressurized fuel from the fuel pump 50 and regulating its pressure to a predetermined pressure, usually subatmospheric, to control the delivery of the fuel from the fuel metering system 46. The fuel metering inlet passage 80 provides fuel to a fuel metering chamber 84 of the fuel metering system 46. The flow control valve 48 operatively obstructs the inlet passage 80 to selectively permit fuel flow from the inlet passage 80 to the fuel metering chamber 84. The flow control valve 48 has a valve body 86, a generally conical valve head 88 extending from the body and engageable with an annular valve seat 90 which defines the inlet of the fuel metering chamber 84, and a needle 92 extending through the valve seat 90 and into the fuel metering chamber 84. A spring 94 bears on the end of the body 86 opposite the needle 92 to yieldably bias the valve 48 to its closed position with the valve head 88 bearing on the valve seat 90 to prevent fuel flow into the fuel metering chamber 84. At its other end, the spring 94 bears on an adjustment member embodied as a screw 96 received in a threaded bore 98 through the carburetor body 42. The position of the screw 96 in the bore 98 can be adjusted to adjust the working length of the spring 94 and hence, the spring force acting on the flow control valve 48 to change the operating characteristics of the valve.

The fuel metering chamber 84 is defined in part by the carburetor body 42 and by a first side 99 of a flexible planar diaphragm 100 sealed along a periphery 102 by the body.

The fuel metering chamber 84 also has a fuel outlet port 104 through which fuel is discharged to be delivered to the engine, and a purge outlet passage 106 interposed by a check valve 108 to permit fluid flow therethrough only when the purge pump assembly 52 is actuated to facilitate removing any fuel vapor or air from the fuel metering chamber 84 and filling it with liquid fuel prior to initial operation of the engine. On an opposite second side 109 of the planar fuel metering diaphragm 100, an air or reference chamber 110 is defined in part by the body 42. The air chamber 110 is maintained at substantially atmospheric pressure by a vent 112 in the chamber 110 which communicates with an atmospheric pressure source, such as the exterior of the carburetor. A substantially rigid disk 114 is disposed in the fuel metering chamber 84 between the planar fuel metering diaphragm 100 and one or more fixed pivots 116 extending from the carburetor body 42 into the fuel metering chamber 84. The disk 114 extends from the fixed pivot points 116 and underlies the needle 92 of the flow control valve 48.

Fuel flows out of the metering chamber fuel outlet port 104 in response to pressure pulses produced in an engine intake manifold which propagate through the fuel and air mixing passage 44, through a fuel flow control assembly 118 and to the fuel metering chamber 84. A negative pressure pulse transmitted to the fuel metering chamber 84 draws fuel out of the metering chamber fuel outlet port 104 creating a pressure differential between the fuel metering chamber 84 and the air chamber 110. This pressure differential across the fuel metering diaphragm 100 causes the diaphragm 100 to move in a direction tending to decrease the volume of the fuel metering chamber 84 and increase the volume of the air chamber 110.

This movement of the planar fuel metering diaphragm 100 moves the disk 114 in a similar direction. Movement of the disk 114 causes it to engage the fixed pivots 116 along one side which tends to rock or pivot the disk 114 into engagement with the needle 92 of the flow control valve 48 at its opposite side. As the pressure differential between the metering chamber 84 and the air chamber 110 increases, the force exerted on the disk 114 by the diaphragm 100 is eventually sufficient to displace the flow control valve 48 to an open position permitting flow of the pressurized fuel in the inlet passage 80 to the fuel pump metering chamber 84. As the pressurized fuel enters the fuel metering chamber 84, the pressure therein increases thereby reducing the pressure differential across the planar diaphragm 100. Likewise, the force exerted on the disk 114 by the diaphragm 100 is then decreased until eventually the force is insufficient to overcome the force biasing the flow control valve 48 to its closed position whereby the flow control valve closes and the flow of fuel into the fuel metering chamber 84 is prevented. In this manner, the flow control valve 48 is continuously cycled between open and closed positions in response to the pressure differential across the planar fuel metering diaphragm 100 to maintain the fuel in the metering chamber 84 at a constant average pressure relative to the pressure in the air chamber 110. Notably, because a negative pressure pulse from the intake manifold is used to actuate the fuel metering diaphragm 100, the average pressure in the fuel metering chamber 84 is at least slightly sub atmospheric.

Fuel discharged from the fuel metering chamber fuel outlet port 104 flows into a main fuel delivery passage 118. The main fuel delivery passage 118 leads to an adjustable low speed needle valve 120 and an adjustable high speed needle valve 122 downstream of the low speed needle valve. Each needle valve 120, 122 is of generally conventional construction arranged to adjustably obstruct respective low and high speed fuel passages 124, 126 which branch off downstream from the main fuel delivery passage 118. Fuel which flows through the low speed fuel delivery passage 124 leads to a plurality of conventional fuel jets 128 communicating with the fuel and air mixing passage 44 near a butterfly throttle valve 130. Fuel which flows through the high speed fuel delivery passage 126 enters a high speed fuel nozzle 132 which is open to the fuel and air mixing passage 44 at a venture 133 of the mixing passage. The high speed fuel nozzle 132 may comprise a restriction or nozzle disposed in a portion of the high speed fuel delivery passage 126.

The fuel and air mixing passage 44 has a venturi portion 134 upstream of the throttle valve 130 received in the passage 44. The throttle valve 130 is movable from an idle position substantially closing the fuel and air mixing passage 44 to limit the fluid flow therethrough, to a wide open position generally parallel with the axis of the passage 44 to permit a substantially unrestricted fluid flow therethrough. The plurality of fuel jets 128 comprise a primary fuel jet 136 disposed downstream of the throttle valve 130 when it is in its closed position and one or more secondary fuel jets 138 disposed upstream of the throttle valve 130 when it is in its closed position. More or less than the number of primary and secondary fuel jets 128 shown may be used as desired for a particular application.

Fuel flows from the fuel metering chamber 84 through the main fuel delivery passage 118, the fuel needle valves 120, 122 and eventually to the idle fuel jets 128 and high speed fuel nozzle 132 in response to the manifold pressure signals as previously mentioned. As shown in FIG. 1, during engine idle operating conditions, the throttle valve 130 is in its idle position substantially closing the fuel and air mixing passage 44. The manifold negative pressure signal is prevented from reaching the high speed fuel nozzle 132 by the throttle valve 130. Thus, there is no fuel flow past the high speed needle valve 122 because there is little or no pressure drop across the high speed fuel nozzle 132 to induce a flow through the high speed fuel delivery passage 126.

At idle, fuel flow required to operate the engine is supplied through the low speed fuel delivery passage 124. However, the secondary fuel jets 138 are not exposed to the manifold vacuum signal due to their position upstream to the throttle valve 130 when it is in its idle position. Rather, air flowing through the fuel-and-air mixing passage 44 bleeds through the secondary fuel jets 138 into a progression pocket portion 139 of the passage 124 providing a fuel-and-air mixture within the progression pocket portion 139. Air flow from the fuel-and-air mixing passage 44 through the high speed fuel delivery passage 126 is preferably prevented by a check valve 140 to control the quantity of air provided to progression pocket portion of the low speed fuel passage 124. The primary fuel jet 136 is exposed to the manifold vacuum signal and hence, the fuel and air mixture within the low-speed fuel passage 124 is drawn through the primary fuel jet 136 into the fuel-and-air mixing passage 44 whereupon it is combined with the air flowing through the passage 44 to be delivered to the engine. Therefore, at engine idle operating conditions all the fuel delivered to the engine is supplied through the primary fuel jet 136. The air bleed through the secondary fuel jets 138 is desirable to provide air into the progression pocket portion 139 and thereby reduce the rate at which liquid fuel is drawn through the primary fuel jet 136 in use. If the secondary fuel jets 138 were not present and air was not provided into the progression pocket portion 139, too much liquid fuel would flow through the primary fuel jet 136 if it were maintained the same size, or in the alternative, a much smaller and much harder to manufacture primary fuel jet would be required to provide the proper liquid fuel flow rate to operate the engine properly at idle operating conditions.

As the throttle valve 130 is rotated from its idle position to its wide open position to increase engine speed, the manifold vacuum from the engine is increasingly exposed to the secondary fuel jets 138. At some point during the throttle valve opening, the negative pressure or pressure drop across the secondary fuel jets 138 becomes great enough such that air is no longer fed from the fuel-and-air mixing passage 44 into the progression pocket portion 139 but rather, fuel in the progression pocket is drawn through the secondary fuel jets 138 into the fuel and air mixing passage 44. The size and spacing of the primary fuel jet 136 and each of the secondary fuel jets 138 in relationship to each other and the throttle valve 130 is very important to the proper operation of a specific engine to ensure that the desired fuel and air mixture is supplied to the engine during its wide range of operating conditions.

When the throttle valve 130 is opened further to its wide open position, the engine manifold vacuum signal reaches the venturi 133 and the high speed fuel nozzle 132 creating a pressure drop across the fuel nozzle 132 and drawing fuel therethrough to be mixed with air flowing through the fuel and air mixing passage 44. Air flow through the venturi 133 also creates a pressure drop across the high speed fuel nozzle 132 to increase the fuel drawn therethrough. The increased vacuum across the high speed fuel nozzle 132 provides an increased flow of fuel through the high speed fuel nozzle which is required for good engine acceleration when the throttle valve 130 is quickly opened from its idle position to its wide open position. The flow area and position of the high speed fuel nozzle 132 relative to the throttle valve 130 and the venturi 133 is important to ensure the desired fuel and air mixture is provided to the engine. At wide open throttle engine operating conditions, a portion of the fuel is also preferably delivered from the fuel jets 128 in addition to that supplied through the high speed fuel nozzle 132.

The air purge assembly 52 is used to prime the carburetor 40 to ensure that liquid fuel is present in all passages from the fuel reservoir to the fuel metering chamber 84 and to remove air and fuel vapor therefrom before the engine is started. This greatly reduces the number of engine revolutions required to start the engine. The air purge assembly 52 comprises a flexible bulb 142 having a radially outwardly extending rim 144 trapped between a cover 146 and the bottom of the carburetor body 42 defining a bulb chamber 148, an air purge inlet passage 150 extending from the purge outlet passage 106 of the fuel metering chamber 84 to the bulb chamber 148, and an air purge outlet passage 152 leading from the bulb chamber 148 to a purge outlet nozzle 154 leading to a fuel reservoir through which fluid pumped out of the carburetor 40 is discharged to the reservoir. A check valve 156 closes the air purge outlet passage 152 until a sufficient pressure within the bulb chamber 148 displaces the check valve 156 to permit fluid flow therethrough into the reservoir. Similarly, the check valve 108 closes the purge outlet passage 106 of the fuel metering chamber 84 to prevent fluid flow from the bulb chamber 148 to the fuel metering chamber 84 when the bulb is depressed and to permit fluid flow out of the fuel metering chamber 84 to the bulb chamber 148 only when a sufficient pressure differential exists across the check valve 108 to open it against the bias of a spring tending to close it.

The air purge process is initiated by depressing the bulb 142 which pushes the air, fuel vapor and/or fuel within the bulb chamber 148 through the outlet passage check valve 156 and the outlet passage 152 back to the fuel reservoir. The check valve 108 at the outlet passage 106 prevents any fluid from being pushed into the fuel metering chamber 84. When the bulb 142 is released, the volume of the bulb chamber 148 increases creating a vacuum because the outlet check valve 156 does not permit fluid flow back into the bulb chamber 148. The vacuum is transmitted through the air purge inlet passage 150 to the check valve 108 disposed within the outlet passage 106. The spring biasing this check valve 108 determines the magnitude or force of the vacuum required to open it and permit fluid in the metering chamber 84 to flow through the air purge inlet passage 150 to the bulb chamber 148. This check valve spring also adds an extra force to the check valve 108 relative to the negative pressure prevailing within the fuel metering chamber 84 during engine operation, to ensure a good seal between the metering chamber 84 and air purge inlet passage 150 to prevent fluid leakage from the fuel metering chamber during all engine operating conditions (exclusive of the air purge process). When the vacuum at the check valve 108 is sufficient to open it, fluid and air within the fuel metering chamber 84 is drawn through the air purge inlet passage 150 into the bulb chamber 186. Subsequent depression of the bulb 142 then forces this fluid and air through the check valve 156 and the outlet passage 152 to the fuel reservoir.

A manual external purge, such as that of the external purge assembly 52, is preferable over other purge devices, such as an automatic choke previously described, because the vacuum transmitted to the fuel metering chamber 84 during the manual purge process is particularly strong and thus capable of displacing the planar diaphragm 104, whereas the common convoluted diaphragm requires less vacuum to cause equal displacement. This displacement created by the strong vacuum when the check valve 108 is open also displaces the disk 114 toward the flow control valve 48 to open it and thereby draw fuel through the fuel pump 50, the fuel metering inlet passage 80 and into the fuel metering chamber 84 to fill them all with liquid fuel. A check valve 158 at the fuel outlet 104 of the fuel metering chamber 84 is closed by the application of the air purge vacuum to the fuel metering chamber 84 to prevent air from being pulled from the fuel and air mixing passage 44, through the fuel jets 128 and fuel delivery passages 124, 126, 118 into the fuel metering chamber 84. Several actuations or depressions of the bulb 142 may be necessary to draw fuel from the reservoir, through the fuel pump 50 and fuel metering system 46 and finally into the bulb chamber 148. The number of actuations of the bulb 142 required is a function of the volume of the bulb chamber 148 compared to the volume of the passages that lead from the fuel reservoir to the bulb chamber.

The flat disk 114 within the fuel metering chamber 84, used to actuate the flow control valve 48, eliminates many of the pockets or cavities required in conventional carburetors to accommodate the levers, inlet valve and a spring biasing the valve lever. Each of these cavities in a conventional carburetor creates a discontinuous surface of the carburetor body in which fuel vapor can collect and coalesce until eventually it is drawn through the fuel passages of the carburetor and delivered to the engine providing a temporarily lean fuel and air mixture to the engine which is undesirable. Further, with the flat disk 144 on the fuel metering diaphragm 100, no holes or openings need be formed through the fuel metering diaphragm 100 as in prior carburetors thereby simplifying its manufacture and assembly into the carburetor and increasing its in service useful life. Desirably, capillary forces between the disk 114 and the wet fuel metering diaphragm 100 are sufficient under normal operating conditions to maintain the disk 114 in contact with the diaphragm 100 so that the disk 114 moves with the diaphragm to actuate the flow control valve 48. Therefore, the disk 114 not only provides a simpler lever or actuating mechanism for the flow control valve 48, it also eliminates a number of the pockets in which fuel vapor collects in conventional carburetors.

Figure 2:
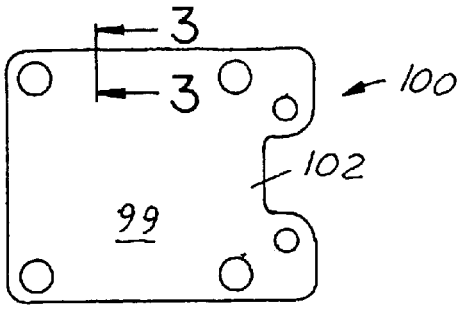
FIG. 2 is a plan view of the planar metering diaphragm.
Figure 3:
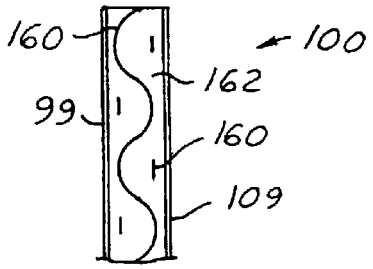
FIG. 3 is an enlarged partial cross-section of the planar metering diaphragm taken along line 3—3 of FIG. 2.

Referring to FIGS. 2–3, the fuel metering diaphragm 100 is substantially flat and without convolutions thereby eliminating the unpredictable fuel metering variation caused by unpredictable clearance variations between the convoluted diaphragm and associated fuel flow control valves. Flat diaphragms also reduce manufacturing costs by eliminating the molding process necessary to produce the convolution. Because the vertical or lateral travel of the flat diaphragm 100 is more exact than that of a convoluted diaphragm, its vertical travel can be minimized while maintaining necessary response of the associated flow control valve 48. This reduced travel of the flat diaphragm 100 improves engine start at elevated ambient temperatures of approximately greater than 90° Fahrenheit or engine start of engines having heated carburetors from prior running periods. This is so because heated liquid fuel disposed downstream at the flow control valve 48 is more susceptible to vapor generation and flash-off of the lighter aromatic constituents. The reduced travel of the flat diaphragm 100 during initial engine start does not move the head 86 of the flow control valve 48 as much as a conventional convoluted diaphragm would. Therefore, for each attempted start of the engine, the head 86 will remain seated or partially restricted permitting less fuel vapor ingestion into the metering chamber 84 during each start attempt. After the engine has started, the fuel delivery pump 50 generates fuel pressure suppressing vapor formation.

The fuel metering diaphragm 100 is preferably a woven synthetic fabric 160, such as nylon, impregnated or layered with an elastomeric coating forming a sheet or a homogeneous thin film polymeric material, and is thus flexible to move in response to a differential pressure across it without the need for the convolution. Also preferably, the diaphragm 100 is formed of a material that swells when exposed to liquid fuel to increase its flexibility and responsiveness. A swell of 2% to 10% is desirable because it increases the flexibility of the diaphragm without having to artificially stretch the diaphragm which makes assembly difficult. Other currently preferred composite materials for the fuel metering diaphragm are mylar/kapton or a high density polyethylene because the materials have excellent flexibility, strength, is resistant to degradation in fuel and resists developing a static charge. The diaphragm is preferably between 0.5 to 2 mil. thick. One specific composite sheet, suitable for a flat fuel diaphragm application, is that made by ContiTech North America, Inc. Montvale, N.J., identified as model number 23-009, made of generally nitrile rubber and woven nylon having a thickness of approximately 0.18 millimeters. Other polymers may also be used such as, for example, linear low density polyethylene, low density polyethylene, fluoroelastomer, fluorosilicone, chlorotrifluoroethylene copolymers, polyvinylidene fluoride, polyvinyl fluoride, polyamide, polyether ether keytone, fluorinated ethylene propylene, and microthin metals such as stainless steel without the use of a woven fabric to name a few. The conventional composite material of woven silk fabric impregnated with nitril for convoluted diaphragms is not preferred for flat diaphragms because this material when fuel soaked stretches too much thus providing little pull to return the diaphragm to its original shape.

Referring to FIGS. 4–7, a second embodiment of a carburetor 40' is illustrated utilizing a flat fuel metering diaphragm 100'. Carburetor 40' is shown as a rotary-type having a manual external purge assembly 52' which utilizes a duck bill type check valve 156' performing the combined functions of metering check valve 108 and purge check valve 156 of the first embodiment.

Figure 5:
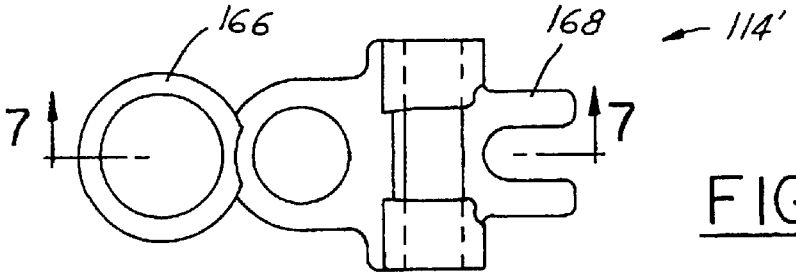
FIG. 5 is a top view of a lever of the second embodiment of the fuel metering system.
Figure 7:
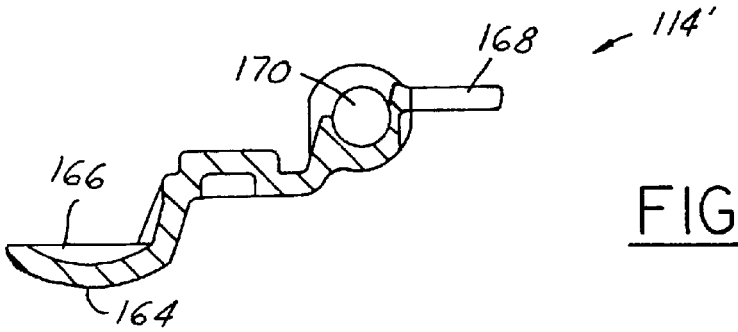
FIG. 7 is a bottom view of the lever.
Figure 6:
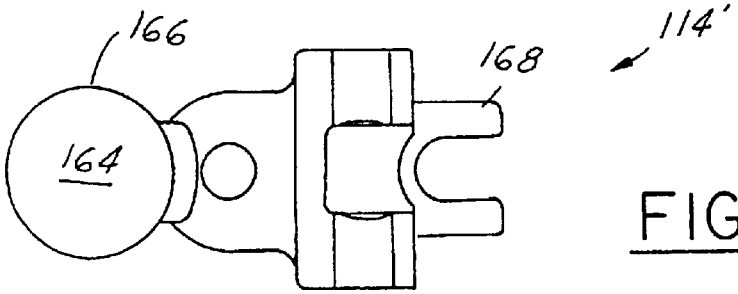
FIG. 6 is a cross-section of the lever taken along line 6—6 of FIG. 5.
Figure 4:
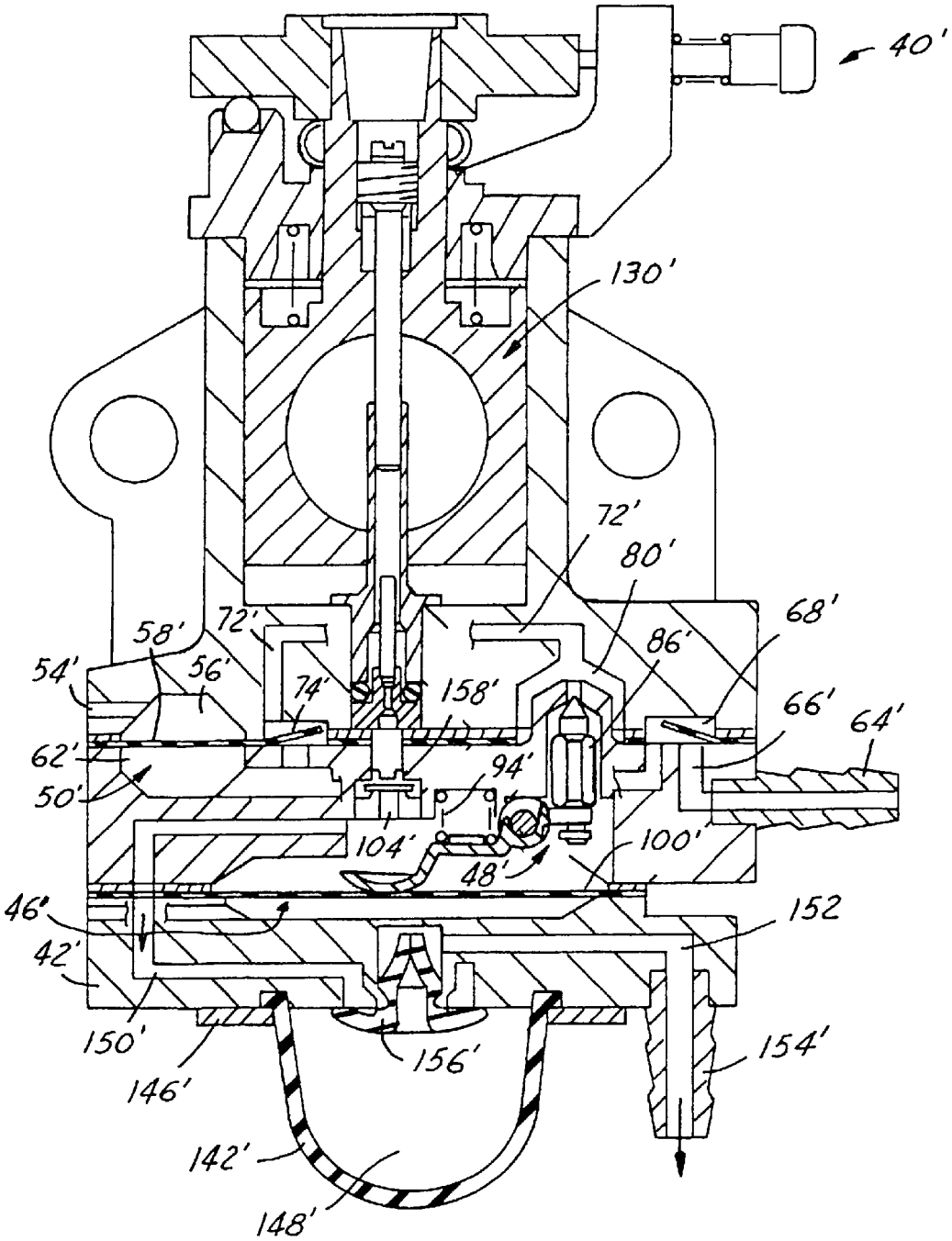
FIG. 4 is a cross-section of an externally purged, rotary type, carburetor having a second embodiment of a fuel metering system.

Of particular interest is the fuel metering system 46' which eliminates the rigid disk 114 of the first embodiment and replaces it with a pivoting lever 114', best shown in FIGS. 5–7. Lever 114' operates similar to lever 28 previously described and illustrated in FIG. 8. However, for a flat diaphragm application, the common rivet 36, washer 34, and plate 32 are not required. Instead, a non-abrasive convex surface 164 of an end or end cup portion 166 of the lever 114' rides directly against an approximate central point of the flat diaphragm 100'. A second opposite end 168 of the elongated lever 114' is fork-like in shape opening along the lever's longitude to operatively engage an end portion of a head of the flow control valve (not shown). An elongated hole or passage 170 is carried by and extends laterally through the lever 114' and snugly receives a rod (not shown) engaged rigidly to the carburetor body and about which the lever pivots. Lever 28 of the prior art has typically been made of aluminum which permits bending of the lever itself within the manufacturing process to adjust for variations in clearance and tolerance of the convolution 22 of the diaphragm 20 if applied, and the flow control valve hardware. Because such variations do not exist with the flat diaphragm 100', as oppose to a convoluted one, the bending operation may be eliminated permitting manufacturing of the non-abrasive lever 114' as a preferable one-piece injection molded plastic part preferably made of a nylon or acetal material.

While the forms of the invention herein disclosed constitute presently preferred embodiments, many others are possible. It is not intended herein to mention all the possible equivalent forms or ramification of the invention. It is understood that terms used herein are merely descriptive, rather than limiting, and that various changes may be made without departing from the spirit or scope of the invention.

We claim:

1. A fuel metering system for a combustion engine carburetor comprising:

a body of the carburetor;

a flat flexible diaphragm having a first side, an opposite second side and a periphery engaged to the body;

a fuel metering chamber defined between the body and the first side of the diaphragm;

a reference chamber defined between the body and the opposite second side of the diaphragm;

a flow control valve being operatively associated with the first side of the diaphragm;

wherein the flat diaphragm flexes into the fuel metering chamber when fuel pressure within the metering chamber is less than the reference pressure of the reference chamber thereby causing the flow control valve to open, and wherein the flat diaphragm returns to datum when the pressure within the metering chamber equals the pressure within the reference chamber causing the flow control valve to close; and wherein the flat diaphragm is a composite material made of a synthetic woven fabric impregnated with a synthetic rubber forming a thin homogeneous sheet that swells between a range of two to ten percent for increasing flexibility.

2. The fuel metering system set forth in claim 1 wherein the fabric is made of nylon and the synthetic rubber is nitrile.

3. A fuel metering system for a combustion engine carburetor comprising:

a body of the carburetor;

a flat flexible diaphragm having a first side, an opposite second side and a periphery engaged to the body;

a fuel metering chamber defined between the body and the first side of the diaphragm;

a reference chamber defined between the body and the opposite second side of the diaphragm;

a flow control valve being operatively associated with the first side of the diaphragm;

wherein the flat diaphragm flexes into the fuel metering chamber when fuel pressure within the metering chamber is less than the reference pressure of the reference chamber thereby causing the flow control valve to open, and wherein the flat diaphragm returns to datum when the pressure within the metering chamber equals the pressure within the reference chamber causing the flow control valve to close;

a rigid disk disposed directly adjacent to the first side of the diaphragm; and the flow control valve having a needle being in direct contact with the rigid disk and orientated perpendicular to the diaphragm.

4. The fuel metering system set forth in claim 3 wherein the flow control valve has a spring for biasing the needle against the disk, and wherein the spring is isolated from the fuel metering chamber when the flow control valve is closed.

5. The fuel metering system set forth in claim 4 wherein the flat diaphragm is a composite material made of a synthetic woven fabric impregnated with a synthetic rubber.

6. A fuel metering system for a combustion engine carburetor comprising:

a body of the carburetor;

a flat flexible diaphragm having a first side, an opposite second side and a periphery engaged to the body;

a fuel metering chamber defined between the body and the first side of the diaphragm;

a reference chamber defined between the body and the opposite second side of the diaphragm;

a flow control valve being operatively associated with the first side of the diaphragm;

wherein the flat diaphragm flexes into the fuel metering chamber when fuel pressure within the metering chamber is less than the reference pressure of the reference chamber thereby causing the flow control valve to open, and wherein the flat diaphragm returns to datum when the pressure within the metering chamber equals the pressure within the reference chamber causing the flow control valve to close; and wherein the flow control valve has a pivoting lever being in direct contact with the diaphragm at a first end and linked to a valve head at the other end.

7. The fuel metering system set forth in claim 6 wherein the first end of the lever has a convex surface engaged non-abrasively to the first side of the diaphragm.

8. The fuel metering system set forth in claim 7 wherein the lever is made of unbent stamped aluminum.

9. The fuel metering system set forth in claim 7 wherein the lever is made of a molded plastic.

10. The fuel metering system set forth in claim 7 wherein the flat diaphragm is a composite material made of a synthetic woven fabric layered with a synthetic rubber.

11. A carburetor comprising:

a body;

a non-convoluted, flat, fuel metering diaphragm having opposed sides carried by the body and being responsive to a difference in pressure on its opposed sides;

an air chamber defined between one side of the flat diaphragm and the body;

a fuel metering chamber defined between the other side of the flat diaphragm and the body and having an inlet in communication with a supply of fuel and an outlet from which fuel is discharged from the fuel metering chamber;

an inlet valve having an annular valve seat and a valve body with a valve head selectively engageable with the valve seat to prevent fluid flow through the valve seat and a needle extending through the valve seat, the valve being yieldably biased to a closed position with the valve head on the valve seat preventing fuel flow into the fuel metering chamber and movable to an open position with the valve head separated from the valve seat to permit fuel flow into the fuel metering chamber; and a substantially rigid disk disposed in the fuel metering chamber and responsive to movement of the diaphragm to selectively and directly engage the needle and move the inlet valve to the open position permitting fuel to flow into the fuel metering chamber when the differential pressure across the diaphragm displaces it sufficiently towards the inlet valve.

12. The carburetor set forth in claim 11 wherein the flat metering diaphragm disposed between the fuel metering and air chambers is not penetrated.

13. A fuel metering system for a combustion engine carburetor comprising:

a body of the carburetor;

a flexible non-penetrated and non-convoluted diaphragm having a non-abrasive first side, an opposite second side and a periphery-engaged to the body;

a fuel metering chamber defined between the body and the first side of the diaphragm;

a reference chamber defined between the body and the opposite second side of the diaphragm;

a flow control valve having a pivoting lever having a non-abrasive first end being in direct contact with the first side of the diaphragm, a valve head being engaged operatively to a second opposite end of the pivoting lever, and a pin engaged to the body and disposed between the first and second ends of the lever about which the lever pivots, wherein the first end of the lever has a convex non-abrasive surface engaged directly to the first side of the diaphragm;

wherein the non-penetrated diaphragm flexes into the fuel metering chamber when fuel pressure within the metering chamber is less than the reference pressure of the reference chamber thereby causing the lever to pivot opening the flow control valve, and wherein the flat diaphragm returns to datum when the pressure within the metering chamber equals the pressure within the reference chamber causing the lever to return pivot thus closing the flow control valve; and wherein the non-penetrated and non-convoluted diaphragm is made of a synthetic woven fabric layered with a synthetic rubber.

* * * * *